US007473347B2

(12) United States Patent
Germaine

(10) Patent No.: US 7,473,347 B2
(45) Date of Patent: Jan. 6, 2009

(54) PROCESS TO PREPARE A LUBRICATING BASE OIL

(75) Inventor: Gilbert Robert Bernard Germaine, Petit Couronne (FR)

(73) Assignee: Shell Oil Company, Houston, TX (US)

( * ) Notice: Subject to any disclaimer, the term of this patent is extended or adjusted under 35 U.S.C. 154(b) by 816 days.

(21) Appl. No.: 10/471,037

(22) PCT Filed: Mar. 5, 2002

(86) PCT No.: PCT/EP02/02452

§ 371 (c)(1),
(2), (4) Date: Sep. 4, 2003

(87) PCT Pub. No.: WO02/070631

PCT Pub. Date: Sep. 12, 2002

(65) Prior Publication Data

US 2004/0104145 A1 Jun. 3, 2004

(30) Foreign Application Priority Data

Mar. 5, 2001 (EP) ..... 01400561

(51) Int. Cl.
*C10G 69/02* (2006.01)

(52) U.S. Cl. ..... 208/89; 208/18; 208/20; 208/60

(58) Field of Classification Search ..... None
See application file for complete search history.

(56) References Cited

U.S. PATENT DOCUMENTS

| | | | | |
|---|---|---|---|---|
| 135,150 | A | 1/1873 | Pearce | |
| 2,603,589 | A | 7/1952 | Schaerer | 196/17 |
| 3,876,522 | A | 4/1975 | Campbell et al. | |
| 3,965,018 | A | 6/1976 | Heilman et al. | 252/59 |
| 4,299,714 | A | 11/1981 | Sugiura et al. | 252/73 |
| 4,343,692 | A | 8/1982 | Winquist | 208/111 |
| 4,574,043 | A | 3/1986 | Chester et al. | |
| 4,582,616 | A | 4/1986 | Kita et al. | 252/17 |
| 4,859,311 | A | 8/1989 | Miller | |
| 4,919,788 | A | 4/1990 | Chen et al. | 208/59 |
| 4,943,672 | A | 7/1990 | Hamner et al. | |
| 4,983,273 | A | 1/1991 | Kennedy et al. | 208/89 |

(Continued)

FOREIGN PATENT DOCUMENTS

| | | |
|---|---|---|
| AU | 698392 | 9/1995 |

(Continued)

OTHER PUBLICATIONS

International Search Report dated Apr. 11, 2003.

(Continued)

*Primary Examiner*—Tam M Nguyen

(57) ABSTRACT

Process to prepare two or more base oil grades, which base oil grades have different kinematic viscositys at 100° C. from a waxy paraffinic Fischer-Tropsch product having a content of non-cyclic iso-paraffins of more than 70 wt % by:

(a) obtaining from the waxy paraffinic Fischer-Tropsch product a distillate fraction having a viscosity corresponding to one of the desired base oil products;

(b) performing a catalytic dewaxing step using the distillate fraction obtained in step (a) as feed;

(c) separating the lower boiling compounds from the dewaxed product obtained in step (b) in order to obtain the desired base oil; and (d) repeating steps (a)–(c) for each base oil.

11 Claims, 1 Drawing Sheet

U.S. PATENT DOCUMENTS

| | | | | |
|---|---|---|---|---|
| 5,053,373 | A | 10/1991 | Zones | |
| 5,059,299 | A | 10/1991 | Cody et al. | |
| 5,082,986 | A | 1/1992 | Miller | 585/667 |
| 5,135,638 | A | 8/1992 | Miller | 208/27 |
| 5,157,191 | A | 10/1992 | Bowes et al. | |
| 5,252,527 | A | 10/1993 | Zones | |
| 5,362,378 | A | 11/1994 | Borghard et al. | 208/138 |
| 5,370,818 | A | 12/1994 | Schleifstein | 252/186.25 |
| 5,372,703 | A | 12/1994 | Kamiya et al. | |
| 5,447,621 | A | 9/1995 | Hunter | 208/58 |
| 5,456,820 | A | 10/1995 | Forbus, Jr. et al. | 208/111 |
| 5,693,598 | A | 12/1997 | Abraham et al. | 508/444 |
| 5,723,716 | A | 3/1998 | Brandes et al. | 585/734 |
| 5,770,542 | A | 6/1998 | Brandes et al. | 502/527 |
| 5,804,058 | A | 9/1998 | Grandvallet et al. | 208/171 |
| 5,856,365 | A | 1/1999 | Zennaro et al. | 518/715 |
| 5,935,417 | A | 8/1999 | Cody et al. | 208/87 |
| 6,059,955 | A | 5/2000 | Cody et al. | |
| 6,060,437 | A | 5/2000 | Robson et al. | 508/371 |
| 6,090,989 | A | 7/2000 | Trewella et al. | 585/13 |
| 6,103,099 | A | 8/2000 | Wittenbrink et al. | 208/27 |
| 6,165,949 | A | 12/2000 | Berlowitz et al. | 508/363 |
| 6,179,994 | B1 | 1/2001 | Clark et al. | 208/27 |
| 6,627,779 | B2 | 9/2003 | O'Rear | 585/302 |
| 6,642,189 | B2 | 11/2003 | Kurihara et al. | 508/364 |
| 2003/0118744 | A1 | 6/2003 | Li et al. | 427/512 |
| 2003/0119682 | A1 | 6/2003 | Saini et al. | 508/167 |
| 2004/0099571 | A1 | 5/2004 | Germaine et al. | 208/108 |
| 2004/0192979 | A1 | 9/2004 | Matthai et al. | 585/16 |

FOREIGN PATENT DOCUMENTS

| | | | |
|---|---|---|---|
| AU | 705415 | | 11/1996 |
| CN | 1167811 | A | 12/1997 |
| EP | 113579 | | 7/1984 |
| EP | 0237655 | | 9/1987 |
| EP | 323092 | | 7/1989 |
| EP | 426223 | | 5/1991 |
| EP | 0471524 | | 2/1992 |
| EP | 532118 | | 3/1993 |
| EP | 0668342 | | 8/1995 |
| EP | 0666894 | | 1/1997 |
| EP | 0776959 | | 6/1997 |
| EP | 0832171 | | 1/2000 |
| EP | 0994147 | | 4/2000 |
| EP | 1102827 | | 9/2002 |
| EP | 1365005 | | 11/2003 |
| EP | 1389635 | | 2/2004 |
| EP | 1400562 | | 3/2004 |
| EP | 1370633 | | 8/2005 |
| EP | 1368446 | | 10/2005 |
| EP | 1366134 | | 11/2005 |
| EP | 1402181 | | 6/2006 |
| EP | 1301272 | | 10/2006 |
| FR | 19990005494 | | 11/2000 |
| FR | 0002364 | | 8/2001 |
| GB | 713910 | | 8/1954 |
| JP | 401133988 | A | 5/1989 |
| JP | 2000345170 | | 12/2000 |
| WO | WO199410263 | | 5/1994 |
| WO | WO199523765 | | 9/1995 |
| WO | WO199603359 | | 2/1996 |
| WO | 97/18278 | | 5/1997 |
| WO | WO199721788 | | 6/1997 |
| WO | 98/02503 | | 1/1998 |
| WO | 99/20720 | | 4/1999 |
| WO | 99/34917 | | 7/1999 |
| WO | 00/14184 | | 3/2000 |
| WO | WO200014179 | | 3/2000 |
| WO | WO200014183 | | 3/2000 |
| WO | WO200014187 | | 3/2000 |
| WO | WO200014188 | | 3/2000 |
| WO | WO200015736 | | 3/2000 |
| WO | 00/29511 | | 5/2000 |
| WO | WO200107469 | | 2/2001 |
| WO | WO200107538 | | 2/2001 |
| WO | WO200118156 | | 3/2001 |
| WO | WO200157166 | | 8/2001 |
| WO | WO0164610 | | 9/2001 |
| WO | WO2001074969 | | 10/2001 |
| WO | WO2002064710 | | 8/2002 |
| WO | WO2002064711 | | 8/2002 |
| WO | WO2002070627 | | 9/2002 |
| WO | WO2002070629 | | 9/2002 |
| WO | WO2002070630 | | 9/2002 |
| WO | WO2002096842 | | 12/2002 |
| WO | WO03004875 | | 1/2003 |

OTHER PUBLICATIONS

Lubricant Base Oil and Wax Processing, Avilino Sequeira, Jr., Marcel Dekker Inc., New York 1994, Chapter 7.

Kirk-Othmer Encyclopedia of Chemical Technology, 3rd edition, vol. 14, pp. 477-526.

Conversion of Natural Gas to Transportation Fuels Via the Shell Middle Distillate Synthesis Process (SNDS). S T Sie et al. Catalysis Today. 8 (1991), pp. 371.

Shell MDS (Malaysia) "Manufacturing Clean Products From Natural Gas", May 1995.

ASTM D86 - Standard Test Method for Distillation of Petroleum Products at Atmospheric Pressure. 2006.

ASTM D1160 - Standard Method for Distillation of Petroleum Products at Reduced Pressure, 2006.

ASTM D2887 Standard Test Method for Boiling Range Distribution of Petroleum Fractions by Gas Chromatography, 2006.

Extract from the website http://www.schu.ac.uk, providing a description of the gas chromatography technique, 2006.

Introduction to Organic Laboratory Techniques, D L Pavia et al. 1976. pp. 614-625.

Letter from the Patentee to the EPO dated Jun. 14, 2004 in European Patent Application No. 02716826.9.

Extract from web-site http://www.deh.gov.au, providing a summary of the development of the European Union fuel standard through the years 1993 and 2000 (so-called "Euro-2" and "Euro-3" respectively) and beyond, for petrol (gasoline) and diesel fuel.

Lewis, Sr., Richard J.: Hawley's Condensed Chemical Dictionary. 14th Ed., John Wiley 7 Sons, New York. 201 (p. 228).

Ballard. D. H., Generalizing the Hough Transformation to Detect Arbitary Shapes. Pattern Recognition. vol. 13., No. 2. pp. 111-122. 1981.

Z. Linag & C. S. Hsu. "Molecular Specification of Saturates by On-Line Liquid Chromatography-Field Ionization Mass Spectrometry", Energy & Fuel, Apr. 1998.

"The Markets for Shell Middle Distillate Synthesis Products", Peter J. A. Tijm et al. Alternative Energy '95. Vancouver, Canada May 2-4, 1995.

Fisher-Tropsch Waxes (LeRoux), Oranje) Part I, Mar. 1984.

Sasolwax H1 Certificate of Analysis, Feb. 14, 1993.

Gas Chromatography Analysis of Saolwax H1 Dec. 10, 2003.

Letter dated Jun. 14, 2004 from Shell to EPO on EP 02762138.7.

Dissertation of Glenda Webber. Sep. 2000, "Wax Characterization by Instrumental Analysis", pp. 52-58.

M.M.G. Senden. "The Shell Middle Distillate Synthesis Process: Commercial plant experience and outlook into the future", Petrolle et Techniques. Association Francaise Des Technic. Paris. Fr., No. 415. Jul. 1998. XP00)771962. pp. 94-97.

Affidavit of John Rosenbaum dated Nov. 4, 2004, filed in connection with opposition proceedings on EP-B-1102827.

Opponent Shell submission in opposition proceedings against EP-B-1102827, letter dated Nov. 2, 2004, pp. 2 and 16-22.

1996 exchange of correspondence between Shell Malaysia and Yukong.

1996 sales invoice of waxy raffinate to Bentley Chemplax (Australia).

Bill from Showa Shell to General Sekiyu dated Jun. 12, 1997.
Affidavit of Mr. Masami Sakaguchi dated Jun. 17, 2004.
Internal Showa Shell note dated Dec. 17, 1996 re shipment of Process Oil 123x.
Sample Request Form for waxy raffinate Jul. 1996.
1993 Showa Shell brochure on XHVI.
Shell records relating to retained sample of commerical XHVI 5.2 base oil, 2004.
1996 exchange of correspondence between Chevron and Shell Malaysia.
R.M. Mortier & S. T. Orszulik. "Chemistry and Technology of Lubricants", 2nd Ed., pp. 4-5. 1997.
Affidavit of Susan Abernathy, filed in the Opposition to EP1368446. Jul. 25, 2006.
Affidavit of Dennis O'Rear, Apr. 2, 2007.
Lucie Coniglio and Armelle Nouviaire "A Method for Estimating the Normal Boiling Point of Heavy Hydrocarbons Suitable for a Group-Contribution-Based Equation of State", published in 2001 by the American Chemical Society. Incl. Eng. Chem. Res. 2001 40. 1781-1790.
SAE Surface Vehicle Standard J300. Rev. Dec. 1999, J. Mass Spectrometry, vol. 31, 383-388 (1996) Klesper & Rollgen.
ASTM D 4684-99, "Standard Test Method for Determination of Yield Stress and Apparent Viscosity of Engine Oils at Low Temperature".
L. Montanari et al., "NMR Molecular Characterization of Lubricating Base Oils: Correlation with Their Performance," *Applied Magnetic Resonance*, 1998, vol. 14, pp. 345-356.
Amarjeet S. Sarpal et al., "Characterization by $^{13}$C n.m.r. spectroscopy of base oils produced by different processes," *Fuel* 1997 vol. 76, No. 10, pp. 931-937.
Nicholas P. Cheremisinoff, Ph. D., "Polymer Characterization Laboratory Techniques and Analysis," 1996, p. 187.
Dieter Klamann, "Lubricants and Related Products," 1984, vol. 9 (Additives).
D. C. Kramer et al., "Influence of Group II & III Base Oil Composition on VI and Oxidation Stability,"1999, NLGI Annual Meetings as found on www.chevron.com/products/prodserv/BaseOils/docs/nigi 10-99.pdf.
W. M. Meier et al., "Atlas of Zeolite Structure Types," Second Revised Edition 1987, pp. 64, 65, 100. 101.
Safety Data Sheet for Shell Base Oils (CAS No. 92062-09-4) Aug. 31, 1996.

PROCESS TO PREPARE A LUBRICATING BASE OIL

FIELD OF THE INVENTION

The invention is directed to a process to prepare a base oil from a waxy paraffinic Fischer-Tropsch product having a content of non-cyclic iso-paraffins of more than 80 wt %.

BACKGROUND OF THE INVENTION

Such a process is known from EP-A-776959. This publication describes a process wherein the high boiling fraction of a Fischer-Tropsch synthesis product is first hydroisomerised in the presence of a silica/alumina supported Pd/Pt catalyst. The isomerised product having a content of non-cyclic iso-paraffins of more than 80 wt % is subsequently subjected to a pour point reducing step. The disclosed pour point reducing step in one of the examples is a catalytic dewaxing step performed in the presence of a silica-supported dealuminated ZSM-23 catalyst at 310° C.

A disadvantage of such a process is that only one grade of base oils is prepared. A next disadvantage is that the hydrosiomerisation step is performed on a narrow boiling range fraction of a Fischer-Tropsch synthesis product, which hydroisomersation step is especially directed to prepare a base oil precursor fraction having the desired properties. The hydroisomerisation process step can also yield valuable large volumes of middle distillates next to base oil precursor fractions if the feed would also include more lower boiling compounds. There is thus a desire to prepare base oils from a waxy paraffinic fraction as obtainable from a hydro-isomerisation process step, which yields both middle distillates, such as naphtha, kerosine and gas oil, and the waxy paraffinic fraction having a content of non-cyclic paraffins of more than 80 wt %. There is also a desire to have a flexible process wherein two or more base oils having different viscosity properties are obtained of excellent quality.

SUMMARY OF THE INVENTION

The object of the present invention is to provide a process wherein two or more high quality base oils are prepared having different viscosities from a waxy Fischer-Tropsch product.

Therefore, the invention is directed to a process to prepare two or more base oil grades, which base oil grades have different kinematic viscosities at 100° C. than a waxy paraffinic Fischer-Tropsch product having a content of non-cyclic iso-paraffins of more than 70 wt % the process comprising (a) obtaining from the waxy paraffinic Fischer-Tropsch product a distillate fraction having a viscosity corresponding to one of the desired base oil products,
(b) performing a pour point reducing step using the distillate fraction obtained in step (a) as feed,
(c) optionally separating the lower boiling compounds from the dewaxed product obtained in step (b) in order to obtain the desired base oil, and
(d) repeating steps (a)–(c) for each base oil.

DETAILED DESCRIPTION OF THE INVENTION

Figure 1:
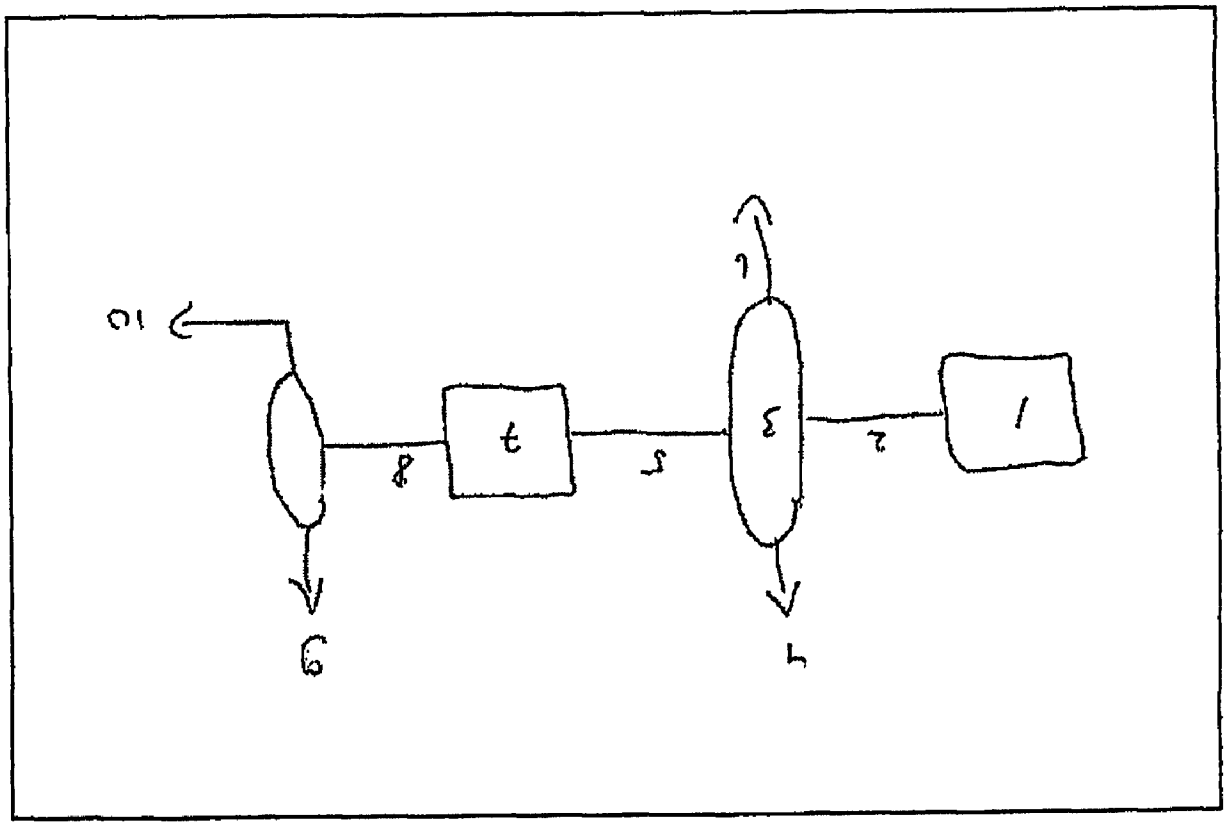
FIG. 1 shows a preferred embodiment of the process according the present invention

Applicants found that by performing the process in the afore mentioned manner a haze free base oil grade having also other excellent quality properties can be prepared. A further advantage is that in step (c) no higher boiling compounds need to be removed. Thus an energy consuming distillation step can be omitted. The advantages are even higher when two or more base oils are prepared having a difference in kinematic viscosity at 100° C. of less than 2 cSt.

The waxy paraffinic Fischer-Tropsch product having the high content of non-cyclic iso-paraffins of more than 70 wt %, preferably more than 80 wt %, can be obtained by well-known processes, for example the so-called commercial Sasol process, the Shell Middle Distillate Process or by the non-commercial Exxon process. These and other processes are for example described in more detail in EP-A-776959, EP-A-668342, U.S. Pat. No. 4,943,672, U.S. Pat. No. 5,059,299, WO-A-9934917 and WO-A-9920720 all of which are hereby incorporated by reference. The process will generally comprise a Fischer-Tropsch synthesis and a hydro-isomerisation step as described in these publications. The hydroisomerisation step is needed to obtain the required content of non-cyclic iso-paraffins in the feed.

In step (a) a distillate fraction having a viscosity corresponding to one of the desired base oil products is obtained from the waxy paraffinic Fischer-Tropsch product. Step (a) is suitably performed by means of distillation of a hydroisomerisation product. The distillation step may include a first distillation at about atmospheric conditions, preferably at a pressure of between 1.2–2 bara, wherein lower boiling fractions, for example naphtha, kerosine and gas oil are separated from a higher boiling fraction. The higher boiling fraction, of which suitably at least 95 wt % boils above 350° C., preferably above 370° C., is subsequently further separated in a vacuum distillation step wherein a vacuum gas oil fraction, the distillate base oil precursor fraction and a higher boiling fraction are obtained. The vacuum distillation is suitably performed at a pressure of between 0.001 and 0.05 bara. When the waxy paraffinic Fischer-Tropsch product is a high boiling mixture, having an initial boiling point of between 330 and 400° C., an atmospheric distillation step may suitably be omitted.

The distillate fraction, or the distillate base oil precursor fraction as obtained in step (a), has a viscosity corresponding to the desired viscosity of the base oil product.

For targeted base oils having a kinematic viscosity at 100° C. of between 4.5 and 6 cSt the kinematic viscosity at 100° C. of the distillate fraction is preferably between 0.05 and 0.3 cSt lower than the target viscosity of the base oil. More preferably the kinematic viscosity at 100° C. of the distillate fraction as obtained in step (a) is between 0.8*P and 1.2*P, wherein $$P = vK@100p - \Delta PP/200.$$

In the above formula vK@100 p is the kinematic viscosity at 100° C. of the base oil product as to be obtained in step (c) expressed in centistokes and APP is the absolute difference in pour point of said fraction obtained in step (a) and said product obtained in step (c) in degrees Celsius. Even more preferably said viscosity is between 0.9*P and 1.1*P and most preferably about 1.

The kinematic viscosity at 100° C. of the distillate fraction is preferably between 3 and 10 cSt. Suitable distillate fractions obtained in step (a) have a T10 wt % boiling point of between 200 and 450° C. and a T90 wt % boiling point of between 300 and 650 more preferably between 300 and 550° C.

In a preferred embodiment a first base oil grade having a kinematic viscosity at 100° C. of between 3.5 and 4.5 cSt and a second base oil grade having a kinematic viscosity at 100°

C. of between 4.5 and 5.5 cSt are advantageously prepared in high yields by performing step (a) in a first mode (v1) to obtain a base oil precursor fraction having a kinematic viscosity at 100° C. corresponding to the first base oil grade and in a second mode (v2) to obtain a base oil precursor fraction having a kinematic viscosity at 100° C. corresponding to the second base oil grade. By performing the pour point reducing step (b) separately on the first and second base oil precursor fractions high quality base oils can be obtained.

In step (b) the distillate base oil precursor fraction obtained in step (a) is subjected to a pour point reducing treatment. With a pour point reducing treatment is understood every process wherein the pour point of the base oil is reduced by more than 10° C., preferably more than 20° C., more preferably more than 25° C.

The pour point reducing treatment can be performed by means of a so-called solvent dewaxing process or by means of a catalytic dewaxing process. Solvent dewaxing is well known to those skilled in the art and involves admixture of one or more solvents and/or wax precipitating agents with the base oil precursor fraction and cooling the mixture to a temperature in the range of from −10° C. to −40° C., preferably in the range of from −20° C. to −35° C., to separate the wax from the oil. The oil containing the wax is usually filtered through a filter cloth which can be made of textile fibres, such as cotton; porous metal cloth; or cloth made of synthetic materials. Examples of solvents which may be employed in the solvent dewaxing process are $C_3$–$C_6$ ketones (e.g. methyl ethyl ketone, methyl isobutyl ketone and mixtures thereof), $C_6$–$C_{10}$ aromatic hydrocarbons (e.g. toluene), mixtures of ketones and aromatics (e.g. methyl ethyl ketone and toluene), autorefrigerative solvents such as liquefied, normally gaseous $C_2$–$C_4$ hydrocarbons such as propane, propylene, butane, butylene and mixtures thereof. Mixtures of methyl ethyl ketone and toluene or methyl ethyl ketone and methyl isobutyl ketone are generally preferred. Examples of these and other suitable solvent dewaxing processes are described in Lubricant Base Oil and Wax Processing, Avilino Sequeira, Jr, Marcel Dekker Inc., New York, 1994, Chapter 7.

Preferably step (b) is performed by means of a catalytic dewaxing process. With such a process it has been found that base oils having a pour point of below −40° C. can be prepared when starting from a base oil precursor fraction as obtained in step (a) of the present process.

The catalytic dewaxing process can be performed by any process wherein in the presence of a catalyst and hydrogen the pour point of the base oil precursor fraction is reduced as specified above. Suitable dewaxing catalysts are heterogeneous catalysts comprising a molecular sieve and optionally in combination with a metal having a hydrogenation function, such as the Group VIII metals. Molecular sieves, and more suitably intermediate pore size zeolites, have shown a good catalytic ability to reduce the pour point of the distillate base oil precursor fraction under catalytic dewaxing conditions. Preferably the intermediate pore size zeolites have a pore diameter of between 0.35 and 0.8 nm. Suitable intermediate pore size zeolites are ZSM-5, ZSM-12, ZSM-22, ZSM-23, SSZ-32, ZSM-35 and ZSM-48. Another preferred group of molecular sieves are the silica-aluminaphosphate (SAPO) materials of which SAPO-11 is most preferred as for example described in U.S. Pat. No. 4,859,311 hereby incorporated by reference. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Ni/ZSM-5, Pt/ZSM-23, Pd/ZSM-23, Pt/ZSM-48 and Pt/SAPO-11. Further details and examples of suitable molecular sieves and dewaxing conditions are for example described in WO-A-9718278, U.S. Pat. No. 5,053,373, U.S. Pat. No. 5,252,527 and U.S. Pat. No. 4,574,043 all of which are incorporated by reference.

The dewaxing catalyst suitably also comprises a binder. The binder can be a synthetic or naturally occurring (inorganic) substance, for example clay, silica and/or metal oxides. Natural occurring clays are for example of the montmorillonite and kaolin families. The binder is preferably a porous binder material, for example a refractory oxide of which examples are: alumina, silica-alumina, silica-magnesia, silica-zirconia, silica-thoria, silica-beryllia, silica-titania as well as ternary compositions for example silica-alumina-thoria, silica-alumina-zirconia, silica-alumina-magnesia and silica-magnesia-zirconia. More preferably a low acidity refractory oxide binder material which is essentially free of alumina is used. Examples of these binder materials are silica, zirconia, titanium dioxide, germanium dioxide, boria and mixtures of two or more of these of which examples are listed above. The most preferred binder is silica.

A preferred class of dewaxing catalysts comprise intermediate zeolite crystallites as described above and a low acidity refractory oxide binder material which is essentially free of alumina as described above, wherein the surface of the aluminosilicate zeolite crystallites has been modified by subjecting the aluminosilicate zeolite crystallites to a surface dealumination treatment. A preferred dealumination treatment is by contacting an extrudate of the binder and the zeolite with an aqueous solution of a fluorosilicate salt as described in for example U.S. Pat. No. 5,157,191 or WO-A-0029511 both are hereby incorporated by reference. Examples of suitable dewaxing catalysts as described above are silica bound and dealuminated Pt/ZSM-5, silica bound and dealuminated Pt/ZSM-23, silica bound and dealuminated Pt/ZSM-12, silica bound and dealuminated Pt/ZSM-22 as for example described in WO-A-0029511 and EP-B-832171 both are hereby incorporated by reference.

Catalytic dewaxing conditions are known in the art and typically involve operating temperatures in the range of from 200 to 500° C., suitably from 250 to 400° C., hydrogen pressures in the range of from 10 to 200 bar, preferably from 40 to 70 bar, weight hourly space velocities (WHSV) in the range of from 0.1 to 10 kg of oil per litre of catalyst per hour (kg/l/hr), suitably from 0.2 to 5 kg/l/hr, more suitably from 0.5 to 3 kg/l/hr and hydrogen to oil ratios in the range of from 100 to 2,000 litres of hydrogen per litre of oil. By varying the temperature between 275 and suitably between 315 and 375° C. at between 40–70 bars, in the catalytic dewaxing step it is possible to prepare base oils having different pour point specifications varying from suitably lower than −60 to −10° C.

After performing a catalytic dewaxing step (b) lower boiling compounds formed during catalytic dewaxing are removed in step (c), preferably by means of distillation, optionally in combination with an initial flashing step.

In step (d) steps (a)–(c) are repeated for every desired base oil.

In a preferred embodiment a first base oil (grade-4) is prepared having a kinematic viscosity at 100° C. of between 3.5 and 4.5 cSt (according to ASTM D 445), a volatility of below 20 wt % and preferably below 14 wt % (according to CEC L40 T87) and a pour point of between −15 and −60° C. (according to ASTM D 97), more preferably between −25 and −60° C., by catalytic dewaxing in step (b) a distillate fraction obtained in step (a) having a kinematic viscosity at 100° C. of between 3.2 and 4.4 cSt and a second base oil (grade 5) is prepared having a kinematic viscosity at 100° C. of between 4.5 and 5.5, a volatility of below 14 wt % and preferably below 10 wt % and a pour point of between −15 and −60° C.), more preferably between −25 and −60° C., by catalytic dewaxing in step (b) a distillate fraction obtained in step (a) having a kinematic viscosity at 100° C. of between 4.2 and 5.4 cSt.

FIG. 1 shows a preferred embodiment of the process according the present invention. In a process (1) a waxy paraffinic Fischer-Tropsch product (2) is prepared having a content of non-cyclic iso-paraffins of more than 70 wt %. From this product (2) a distillate fraction (5) is obtained in distillation column (3) by separating of a light (4) and heavy fraction (6). This fraction (5) has a viscosity which corresponds with the desired base oil grade (10). In reactor (7) a catalytic dewaxing step is performed on the fraction (5) thereby obtaining a dewaxed oil (8). By separating off light fraction (9) in distillation column (11) the desired base oil grade (10) is obtained. By variation of the separation in distillation column (3) the properties of base oil grade (10) can be varied according to the process of the present invention.

The above-described Base oil grade-4 can suitably find use as base oil for an Automatic Transmission Fluids (ATF). If the desired kinematic viscosity at 100° C. (vK@100) of the ATF is between 3 and 3.5 cSt, the Base Oil grade-4 is suitably blended with a grade having a vK@100 of about 2 cSt. The base oil (grade-2) having a kinematic viscosity at 100° C. of about 2 to 3 cSt can suitably be obtained by catalytic dewaxing of a suitable gas oil fraction as obtained in the atmospheric distillation in step (a) as described above. The Automatic Transmission Fluid will comprise the base oil (blend) as described above, preferably having a vK@100 of between 3 and 6 cSt, and one or more additives. Examples of additives are antiwear, antioxidant, and viscosity modifier additives.

The invention is furthermore directed to a novel class of base oils having a saturates content of above 95 wt %, preferably above 97 wt %, a kinematic viscosity at 100° C. of between 8 and 12 cSt, preferably above 8.5 cSt and a pour point of below −30° C. and a viscosity index of above 120 preferably above 130. The combination of such low pour point high viscosity index fluids containing almost only cyclo, normal and iso-paraffins is considered-novel. Such base oils may be advantageously used as white oils in medicinal or food applications. To obtain a base oil having the desired colour specification it may be required to hydrofinish the base oil, for example using a noble metal hydrofinishing catalyst C-624 of Criterion Catalyst Company, or by contacting the base oil with active carbon. Base oils having a colour according to ASTM D 1500 of less than 0.5 and according to ASTM D 156 Saybolt of greater than +10 and even equal to +30 can thus be obtained.

The base oils obtained by the present process having intermediate vK@100 values of between 2 and 9 cSt, of which preferred grade-4 and grade-5 have been described above, are preferably used as base oil in formulations such as gasoline engine oils, diesel engine oils, electrical oils or transformer oils and refrigerator oils. The use in electrical and refrigerator oils is advantageous because of the naturally low pour point when such a base oil, especially the grades having a pour point of below −40° C., is used to blend such a formulation. This is advantageous because the highly iso-paraffinic base oil has a naturally high resistance to oxidation compared to low pour point naphthenic type base oils. Especially the base oils having the very low pour points, suitably lower than −40° C., have been found to be very suitable for use in lubricant formulations such as gasoline and diesel engine oils of the 0W–x specification according to the SAE J-300 viscosity classification, wherein x is 20, 30, 40, 50 or 60. It has been found that these high tier lubricant formulations can be prepared with the base oils obtainable by the process of the current invention. Other gasoline and diesel engine oil applications are the 5W–x and the 10W–x formulations, wherein the x is as above. The gasoline oil formulation will suitably comprise the above-described base oil and one or more of additives. Examples of additive types which may form part of the composition are dispersants, detergents, viscosity modifying polymers, extreme pressure/antiwear additives, antioxidants, pour point depressants, emulsifiers, demulsifiers, corrosion inhibitors, rust inhibitors, antistaining additives, friction modifiers. Specific examples of such additives are described in for example Kirk-Othmer Encyclopedia of Chemical Technology, third edition, volume 14, pages 477–526.

The invention will be illustrated by the following non-limiting examples.

EXAMPLE 1

1000 g per hour of a distillate fraction of an isomerised Fischer-Tropsch product having the properties as Feed N° 1 in Table 1 was fed to a catalytic dewaxing reactor. The effluent of the catalytic dewaxing reactor was topped at 390° C. to remove only the light boiling fraction. The thus obtained base oil was recovered in a 69 wt % yield based on Feed N° 1. The dewaxing conditions are as in Table 2. The catalyst used in the dewaxing step was a Pt/silica bound ZSM-5 catalyst as described in Example 9 of WO-A-0029511. The properties of the thus obtained base oils are in Table 3.

EXAMPLE 2

Example 1 was repeated except at different dewaxing conditions (see Table 2). The properties of the base oil are in Table 3.

TABLE 1

| Feed No. | 1 | 2 |
|---|---|---|
| Density at 70° C. | 784.8 | 784.5 |
| T10 wt % boiling point (° C.) | 407 | 346 |
| T90 wt % boiling point (° C.) | 520 | 610 |
| Kinematic viscosity at 10° C. (cSt) | 5.151 | 6.244 |
| Pour point (° C.) | +46 | +30 |

TABLE 2

| Dewaxing conditions | Example 1 | Example 2 |
|---|---|---|
| Reactor temperature (° C.) | 325 | 342 |
| Hydrogen pressure (bar) | 37 | 36 |
| Weight hourly space velocity (kg/l/h) | 1.0 | 1.0 |
| Hydrogen flow rate (Nl/h) | 700 | 700 |

TABLE 3

| | Example 1 | Example 2 |
|---|---|---|
| Feed | Feed No. 1 | Feed No. 1 |
| Base oil properties | | |
| Density at 20° C. (kg/m$^3$) | 819.7 | 819.0 |
| Kinematic viscosity at 100° C. (cSt) | 5.51 | 5.41 |
| Pour Point (° C.) | −20 | −48 |
| Noack (wt %) | 6.3 | 7.4 |

EXAMPLE 3

Example 1 was repeated at the conditions described in Table 4 using Feed No. 2 (see Table 1). The properties of the resulting base oil are presented in Table 5.

EXAMPLE 4

Example 1 was repeated at the conditions described in Table 4 using Feed No. 2 (see Table 1). The properties of the resulting base oil are presented in Table 5.

TABLE 4

| Dewaxing conditions | Feed 2 Example 3 | Feed 2 Example 4 |
|---|---|---|
| Reactor temperature (° C.) | 290 | 296 |
| Hydrogen pressure (bar) | 48 | 47 |
| Weight hourly space velocity (kg/l/h) | 1.0 | 1.0 |
| Hydrogen flow rate (Nl/h) | 750 | 750 |

TABLE 5

| Base oil properties | Feed 2 Example 1 | Feed 2 Example 2 |
|---|---|---|
| Density at 20° C. (kg/m$^3$) | 826 | 825.9 |
| Kinematic viscosity at 100° C. (cSt) | 9.78 | 9.75 |
| Viscosity index | 151 | 151 |
| Pour Point (° C.) | −9 | −30 |
| Noack (wt %) | 6.1 | 6.0 |

The above experiments illustrate that base oils having a kinematic viscosity at 100° C. in the range of 3 to 12 cSt and especially 4 to 12 cSt having excellent properties like pour point and viscosity index can be obtained using the process according to the invention. It will be clear that by performing step (a) and (b) in a controlled manner according to the present invention all viscosity grades in that range can be sequentially obtained.

I claim:

1. A process to prepare two or more base oil grades, which base oil grades having different kinematic viscosities at 100° C. than a waxy paraffinic Fischer-Tropsch product having a content of non-cyclic iso-paraffins of more than 70 wt %, the process comprising:

(a) obtaining from the waxy paraffinic Fischer-Tropsch product a distillate fraction having a viscosity corresponding to one of the desired base oil grades;

(b) performing a catalytic dewaxing step using the distillate fraction obtained in step (a) as feed to produce a dewaxed product comprising lower boiling compounds;

(c) separating the lower boiling compounds from the dewaxed product obtained in step(b) in order to obtain the base oil grade; and (d) repeating steps (a)–(c) for each base oil grade, wherein the base oil having a kinematic viscosity at 100° C. of between 4.5 cSt and 6 cSt is prepared and wherein the kinematic viscosity at 100° C. of the distillate fraction as obtained in step (a) is between 0.8*P and 1.2*P, wherein P=vK@100 p−ΔPP/200, in which equation vK@100 p is the kinematic viscosity at 100° C. of the base oil product as obtained in step (c) and ΔPP is the absolute difference in pour point of said fraction obtained in step (a) and said product obtained in step (c) in degrees Celsius.

2. The process of claim 1, wherein the waxy paraffinic Fischer-Tropsch product has a content of non-cyclic iso-paraffins of more than 80 wt %.

3. The process of claim 1, wherein the kinematic viscosity at 100° C. of each of the different base oil grades differs from the kinematic viscosity at 100° C. of each of the other base oil grades by less than 2 cSt.

4. The process of claim 1, wherein the distillate fraction has a T10 wt % boiling point of between 200° C. and 450° C. and a T90 wt % boiling point of between 300° C. and 550° C.

5. The process of claim 4, wherein the distillate fraction has a kinematic viscosity at 100° C. of between 3 cSt and 10 cSt.

6. The process of claim 1, wherein step (b) is performed by solvent dewaxing.

7. The process of claim 1, wherein step (b) is performed by catalytic dewaxing.

8. The process of claim 7, wherein the catalytic dewaxing is performed in the presence of a catalyst comprising a Group VIII metal; an intermediate pore size zeolite having pore diameter between 0.35 nm and 0.8 nm; and, a low acidity refractory binder which binder is essentially free of alumina.

9. The process of claim 1, wherein the kinematic viscosity at 100° C. of the distillate fraction as obtained in step (a) is between 0.9*P and 1.1*P.

10. The process of claim 9, wherein the kinematic viscosity at 100° C. of the distillate fraction as obtained in step (a) is about equal to p.

11. The process of claim 1, wherein a first base oil is prepared having a kinematic viscosity at 100° C. of between 3.5 cSt and 4.5 cSt, a volatility of below 11 wt % and a pour point of between −15° C. and −60° C. by catalytic dewaxing in step (b) a distillate fraction obtained in step (a) having a kinematic viscosity at 100° C. of between 3.2 cSt and 4.4 cSt and a second base oil is prepared having a kinematic viscosity at 100° C. of between 4.5 and 5.5, a volatility of below 14 wt % and a pour point of between −15° C. and −60° C. by catalytic dewaxing in step (b) a distillate fraction obtained in step (a) having a kinematic viscosity at 100° C. of between 4.2 cSt and 5.4 cSt.

* * * * *